US007053031B2

(12) United States Patent
Jeschke et al.

(10) Patent No.: US 7,053,031 B2
(45) Date of Patent: May 30, 2006

(54) CLEANING AGENTS FOR THE OUTER SURFACES OF MEANS OF TRANSPORT

(75) Inventors: Ingo Jeschke, Burgkirchen (DE); Achim Stankowiak, Altoetting (DE); Wolfgang Huber, Burgkirchen (DE)

(73) Assignee: Clariant GmbH, Frankfurt (DE)

( * ) Notice: Subject to any disclaimer, the term of this patent is extended or adjusted under 35 U.S.C. 154(b) by 119 days.

(21) Appl. No.: 10/501,133

(22) PCT Filed: Dec. 18, 2002

(86) PCT No.: PCT/EP02/14444

§ 371 (c)(1),
(2), (4) Date: Jul. 9, 2004

(87) PCT Pub. No.: WO03/057812

PCT Pub. Date: Jul. 17, 2003

(65) Prior Publication Data

US 2005/0107284 A1 May 19, 2005

(30) Foreign Application Priority Data

Jan. 11, 2002 (DE) ..... 102 00 727

(51) Int. Cl.

| | |
|---|---|
| ***C11D 1/75*** | (2006.01) |
| ***C11D 3/20*** | (2006.01) |
| ***C11D 3/26*** | (2006.01) |
| ***C11D 3/37*** | (2006.01) |

(52) U.S. Cl. ..... 510/189; 510/245; 510/254; 510/477; 510/480; 510/499; 510/503

(58) Field of Classification Search ..... None

See application file for complete search history.

(56) References Cited

U.S. PATENT DOCUMENTS

| | | | | |
|---|---|---|---|---|
| 3,458,300 | A | 7/1969 | Duvall et al. | |
| 3,491,027 | A | 1/1970 | Baker et al. | |
| 3,948,819 | A | 4/1976 | Wilde | |
| 5,443,651 | A | 8/1995 | Kalota et al. | |
| 5,496,413 | A | 3/1996 | Phillips | |
| 5,516,449 | A | 5/1996 | Agar et al. | |
| 5,516,459 | A | 5/1996 | Van Eenam | |
| 5,880,078 | A | 3/1999 | Bevilacqua et al. | |
| 5,922,669 | A | 7/1999 | Quebedeaux et al. | |
| 2002/0160924 | A1* | 10/2002 | Bertrem et al. | 510/189 |

FOREIGN PATENT DOCUMENTS

| | | |
|---|---|---|
| DE | 235 3860 | 5/1974 |
| DE | 100 28411 | 2/2002 |
| GB | 1443426 | 5/1974 |
| JP | 57 128797 | 8/1982 |
| WO | WO 99/27054 | 6/1999 |

* cited by examiner

*Primary Examiner*—Gregory R. Del Cotto
(74) *Attorney, Agent, or Firm*—Richard P. Silverman

(57) ABSTRACT

The invention relates to the use of a composition for cleaning the outside of a means of transport. The composition contains component a) at least one tertiary amino oxide of formula $R_1$ $R_2$ $R_3$ NO, whereby $R_1$ represents an alkylamidoalkyl, alkenylamidoalkyl, alkoxypropylamidoalkyl or alkenylamidoalkyl group having between 8–18 carbon atoms, $R_2$ and $R_3$ represent, independently from each other, low molecular alkyl radicals or hydroxyethyl radicals or hydroxypropyl radicals, and component b) at least one alkali metal salt of polyasparaginic acid having a molecular weight of between 5,000 g/mol–50,000 g/mol, or a polyglutaminic acid having a molecular weight of between 5,000 g/mol–50,000 g/mol, or a mixture of both substances, whereby the weight ratio of the components a:b is between 10:1 and 3000:1. The cleaner of the present invention effectively removes dirt and comprises environmentally friendly corrosion inhibitors.

5 Claims, No Drawings

CLEANING AGENTS FOR THE OUTER SURFACES OF MEANS OF TRANSPORT

The present invention relates to cleaning compositions for removing severe contamination from exterior surfaces of means of transport, comprising amine oxides and polypeptides.

On the exterior surfaces of means of transport, such as automobiles, trucks, trains, streetcars, and aircraft in particular, for example, severe, difficult-to-remove soiling is a regular occurrence. Particularly on the outer skin of aircraft, such soiling is intolerable.

Aircraft exterior cleaners do not serve exclusively for cleaning dirty aircraft; rather, they are also essential for the economic operation of aircraft. In the course of flight operation, aluminum surfaces on aircraft become permanently contaminated by airfuel, carbon from the waste combustion gases, and lubricant. As a result of the soiling the surface roughness increases, and so the airflow necessary for lift becomes slightly more turbulent. As a result, an increased propulsion force and hence also more fuel is needed in order to hold the aircraft at the desired speed of travel. Contamination may additionally cause corrosion of the aluminum components, which can lead to significant impairment of flying safety.

Aircraft exterior cleaners are required to satisfy a large number of requirements. In accordance with the SAE specification AMS (Aerospace Material Standards) 1526 (cleaner for aircraft exterior surfaces, water-miscible, pressure-spraying type) corrosiveness, hydrogen embrittlement, materials compatibility, and the stability of the cleaning composition are investigated.

In the state of the art there are known aircraft exterior cleaners which are aqueous solutions of surfactants, organic solvents, and inorganic substances. The inorganic ingredients promote the abrasion of the dirt particles. However, these water-insoluble constituents often give rise to a matt film on the aircraft surface, unless the cleaner is rinsed off fully with clean water afterward. In the disposal of the cleaners, the organic solvents are very harmful to aquatic organisms. In addition they cause unpleasant odors and, as a result of their low vapor pressure, they increase the risk of ignition.

In the state of the art, aircraft cleaning compositions have generally been formulated with poorly degradable and environmentally hazardous corrosion inhibitors, such as sodium nitrate, sodium nitrite or thiourea.

U.S. Pat. No. 3,458,300 discloses a cleaner which comprises aluminum oxide particles intended to remove the dirt from aircraft surfaces by abrasion. Surfactants with an antistatic action prevent the dirt particles resettling on the outer skin.

U.S. Pat. No. 3,491,027 discloses a cleaning solution which is employed on aircraft which operate predominantly in the vicinity of the sea. The composition is suitable for removing salt deposits from aircraft surfaces.

U.S. Pat. No. 3,948,819 discloses the synergistic effect obtained through the choice of two nonionic surfactants as dirt dissolvers. A method is described for assessing the cleaning effect.

U.S. Pat. No. 5,496,413 discloses the combination of cleaning and waxing components in a single cleaner.

U.S. Pat. No. 5,516,459 discloses the use of alkylamine oxides in thickened aircraft exterior cleaners; however, the cleaner has a pH which is well within the alkaline range, and requires environmentally harmful alkali metal nitrites for inhibiting corrosion.

U.S. Pat. No. 5,880,078 discloses how the desired dirt dissolution characteristics can be obtained by means of a combination of ethoxylated fatty alcohols having different HLB values.

From the state of the art it is clear that the development of aircraft exterior cleaners has to date concentrated almost exclusively on improving the cleaning effect. Only little effort has so far been expended on formulating aircraft exterior cleaners simultaneously with more environmentally compatible corrosion inhibitors.

The object of the invention was therefore to develop an aircraft exterior cleaner which not only effectively removes dirt but also comprises environmentally friendly corrosion inhibitors. The cleaner ought also to be free from solvents and other substances which, owing to their low vapor pressure, may cause unpleasant odors, are readily ignitable, and, furthermore, may be hazardous to health. The cleaner should be suitable not only for aircraft but also for other means of transport.

Surprisingly it has now been found that cleaning compositions based on tertiary amine oxides and polypeptides as corrosion inhibitors have a particularly good activity.

The invention accordingly provides for the use of a composition for the exterior cleaning of means of transport, comprising a) at least one tertiary amine oxide of the formula $R_1R_2R_3NO$, where $R_1$ is an alkyl, alkenyl, alkoxypropyl or alkenylamidoalkyl group having 8 to 18 carbon atoms, $R_2$ and $R_3$ independently of one another are low molecular mass alkyl radicals or hydroxyethyl or hydroxypropyl radicals, b) at least one alkali metal salt of polyaspartic acid, having a molecular weight of from 5000 g/mol to 50 000 g/mol, or of polyglutamic acid, having a molecular weight of from 5000 g/mol to 50 000 g/mol, or a mixture of both substances, the weight ratio of the constituents a):b), being between 10:1 and 3000:1.

Weight percentages below are in each case based on the weight of the composition. In one preferred embodiment the composition contains 10 to 30% by weight of constituent a), 0.01 to 1% by weight of constituent b), and water to 100% by weight. The preferred weight ratio between constituents a) and b) is between 15:1 and 2500:1.

The invention preferably provides for the use of the composition of the invention as an exterior cleaning composition for aircraft.

The invention further provides a method for the exterior cleaning of means of transport, in particular of aircraft, by applying the composition of the invention to the outer skin of the means of transport that is to be cleaned.

Constituent a) of the composition of the invention makes up preferably 15 to 25% by weight of the total weight. $R_1$ is preferably an alkyl, alkenyl, alkoxypropyl or alkenylamidoalkyl group having 10 to 16 carbon atoms. $R_2$ and $R_3$ are preferably alkyl radicals having 1 to 6, in particular 1 to 4, carbon atoms or else can be hydroxyethyl or hydroxypropyl radicals. Examples of constituent a) that may be mentioned include the following: cocoalkyldimethylamine oxide, stearyldimethylamine oxide, lauryldimethylamine oxide, and $C_{14}$-alkyldimethylamine oxide. Component a) can also be a mixture of said amine oxides.

Constituent b) is an alkali metal salt of polyaspartic acid or of polyglutamic acid, having a molecular weight of preferably from 7000 g/mol to 20 000 g/mol, or a mixture of both substances. These are readily degradable, nontoxic, and water-soluble biopolymers, in this case specifically polypeptides. To date these compounds have been used primarily as dispersants in cooling water and for removing lime deposits. It has become apparent that these substances are likewise outstandingly suitable as corrosion inhibitors for use in aircraft exterior cleaners. In addition, defoamers, dyes, complexing agents, and antioxidants may be present in the cleaners.

The pH of aircraft exterior cleaners ought generally to be from 6.5 to 11, preferably 9 to 10. If the composition of the invention does not have such a pH, the pH can be adjusted by means of suitable pH regulators. Basic compounds suitable for this purpose are those from the group of the alkali metal hydroxides, such as NaOH and KOH.

The composition of the invention is prepared by mixing the individual constituents in any order, which can be done, for example, in a vessel equipped with stirrer.

The resulting formulations exhibit an outstanding dirt dissolution power. Practical tests on motor vehicles have shown that they can be used to remove easily even stubborn insect contamination on windshields. The composition does not leave any streaks, contains no organic solvents, and contains only environmentally friendly and readily degradable corrosion inhibitors.

Slight soiling can be removed without problems with the cleaner diluted 1:15 with water. In the case of stubborn soiling a dilution of 1:5 is recommended.

The invention is now illustrated by examples.

EXAMPLES

The cleaning effect is assessed by means of dirt dissolution tests. For this purpose a 2024-T3 aluminum panel measuring 5×2 cm with a thickness of 1 mm is used. Before the beginning of the test, the aluminum panel is etched first with a dilute sodium hydroxide solution and then with a dilute nitric acid solution. This roughens the surface, so that particles of dirt are better able to settle on the panel. The panel is provided alternately with different forms of contamination. These include bearing grease, vaseline, and synthetic aircraft soiling.

100 g of this synthetic aircraft soiling are composed of 1 g of lanolin, 20 g of activated carbon, 10 g of talc, 15 g of lubricating oil, and 54 g of kerosene. The components are intimately mixed with one another and applied in a thin film to the aluminum panel. The dirt is subsequently baked into the aluminum panel at 100° C. in a drying oven for 12 hours.

In order to assess the dirt dissolution power, the aluminum panel treated with bearing grease, vaseline or synthetic aircraft soiling is immersed in a solution of 100 ml of cleaning composition. The solution is in a glass beaker in which a magnetic stirrer rotates at 500 revolutions per minute. At regular intervals an assessment is made of the dirt components which have detached.

Example 1

An inventive aircraft cleaning composition is prepared by mixing the following components (concentrate):

| | |
|---|---|
| 15.00% by weight | $C_{12}/C_{14}$-alkyldimethylamine oxide |
| 0.20% by weight | alkali metal polyaspartate with 15 000 g/mol |
| 0.45% by weight | sodium hydroxide |
| 84.35% by weight | water. |

The dirt dissolution power of this cleaning composition is investigated on the basis of the method described above. Within just a few minutes, both the concentrate and the 1:1 and 1:2 dilutions with water detach the bearing grease, vaseline, and synthetic aircraft soiling contaminants completely from the aluminum plates.

Further investigations on the aircraft cleaning composition described in example 1 reveal that all of the other requirements of the SAE specification AMS 1526 are met. The composition causes no corrosion to aluminum, magnesium, and steel alloys and adversely affects neither acrylic glass nor painted and unpainted aircraft surfaces.

Example 2

An inventive aircraft cleaning composition is prepared by mixing the following components (concentrate):

| | |
|---|---|
| 25.00% by weight | lauryldimethylamine oxide |
| 0.20% by weight | alkali metal polyglutamate with 35 000 g/mol |
| 0.40% by weight | potassium hydroxide |
| 74.4% by weight | water. |

This cleaning composition likewise detaches all contaminants and meets the requirements of SAE specification AMS 1526.

Example 3

An inventive aircraft cleaning composition is prepared by mixing the following components (concentrate):

| | |
|---|---|
| 20.00% by weight | cocoalkyldimethylamine oxide |
| 0.20% by weight | alkali metal polyaspartate with 10 000 g/mol |
| 0.35% by weight | sodium hydroxide |
| 79.45% by weight | water. |

This cleaning composition likewise detaches all contaminants and meets the requirements of SAE specification AMS 1526.

The invention claimed is:

1. A method for cleaning an exterior surface of a selected from the group consisting of automobile, a truck, a train, a streetcar, and an aircraft means of transport composition, said method comprising contacting said means of transport with a composition comprising:

a) at least one tertiary amine oxide of the formula $R_1R_2R_3NO$, where $R_1$ is an alkyl, alkenyl, alkoxypropyl or alkenylamidoalkyl group having 8 to 18 carbon atoms, $R_2$ and $R_3$ independently of one another are of 1 to 6 carbon atoms alkyl radicals of 1 to 6 crabon atoms, or hydroxyethyl hydroxyethyl radicals, and b) at least one alkali metal salt of an acid selected from the group consisting of a polyaspartic acid, a polyglutamic acid, or a mixture thereof, said acid having a molecular weight of from 5000 g/mol to 50 000 g/mol, wherein a weight ratio of the constituents a):b) is between 10:1 and 3000:1.

2. The method of claim 1, wherein $R_1$ is selected from the group consisting of an alkyl, alkenyl, alkoxypropyl, alkenylamido, and mixtures thereof wherein $R_1$ has 10 to 16 carbon atoms.

3. The method of claim 1, wherein the molecular weight of b) is from 7000 to 20 000 g/mol.

4. The method of claim 1, wherein the composition further comprises a compound selected from the group consisting of defoamers, dyes, complexing agents, antioxidants and mixtures thereof.

5. The method of claim 1 wherein the means of transport is an aircraft.

* * * * *